US010354820B2

(12) United States Patent
Dorn et al.

(10) Patent No.: US 10,354,820 B2
(45) Date of Patent: Jul. 16, 2019

(54) DEVICE FOR SWITCHING A DIRECT CURRENT

(71) Applicant: SIEMENS AKTIENGESELLSCHAFT, Munich (DE)

(72) Inventors: Joerg Dorn, Buttenheim (DE); Dominik Ergin, Baiersdorf (DE); Herbert Gambach, Uttenreuth (DE)

(73) Assignee: Siemens Aktiengesellschaft, Munich (DE)

( * ) Notice: Subject to any disclaimer, the term of this patent is extended or adjusted under 35 U.S.C. 154(b) by 215 days.

(21) Appl. No.: 15/113,056

(22) PCT Filed: Jan. 21, 2014

(86) PCT No.: PCT/EP2014/051100
§ 371 (c)(1),
(2) Date: Jul. 21, 2016

(87) PCT Pub. No.: WO2015/110142
PCT Pub. Date: Jul. 30, 2015

(65) Prior Publication Data

US 2017/0011875 A1 Jan. 12, 2017

(51) Int. Cl.
*H01H 9/30* (2006.01)
*H01H 33/59* (2006.01)
*H01H 9/54* (2006.01)

(52) U.S. Cl.
CPC ..... *H01H 33/596* (2013.01); *H01H 9/542* (2013.01); *H01H 2009/544* (2013.01)

(58) Field of Classification Search
USPC ..... 361/13, 2–10; 307/51, 52
See application file for complete search history.

(56) References Cited

U.S. PATENT DOCUMENTS 5,164,872 A * 11/1992 Howell ..... H01H 9/548 361/11
6,498,464 B1 * 12/2002 Doht ..... H02J 3/04 323/247
9,774,187 B2 * 9/2017 Eckel ..... H02J 3/36
9,882,371 B2 * 1/2018 Bakran ..... H01H 9/542
2012/0092912 A1 * 4/2012 Eckel ..... H02M 1/08 363/123

(Continued)

FOREIGN PATENT DOCUMENTS

CN 203385782 U 1/2014
DE 102007004527 A1 7/2008

(Continued)

OTHER PUBLICATIONS

RU 2299487 machine translation form USPTO-(STIC).*

*Primary Examiner* — Ronald W Leja
(74) *Attorney, Agent, or Firm* — Laurence Greenberg; Werner Stemer; Ralph Locher

(57) ABSTRACT

A device for switching a direct current includes an operating current path which has a mechanical switch, a switch-off current path which is connected in parallel to the operating current path and has a power-electronic switch, and a commutation device which allows commutation of the direct current from the operating current path into the switch-off current path. The commutation device includes a transformer.

22 Claims, 2 Drawing Sheets

(56) References Cited

U.S. PATENT DOCUMENTS

| | | | | |
|---|---|---|---|---|
| 2012/0299393 | A1* | 11/2012 | Hafner | H01H 9/542<br>307/113 |
| 2015/0207310 | A1 | 7/2015 | Bakran | |

FOREIGN PATENT DOCUMENTS

| | | | |
|---|---|---|---|
| JP | H07141966 | A | 6/1995 |
| JP | 2010287460 | A | 12/2010 |
| JP | 2012079660 | A | 4/2012 |
| RU | 2299487 | C1 | 5/2007 |
| WO | 2008090178 | A1 | 7/2008 |
| WO | 2013131580 | A1 | 9/2013 |
| WO | 2013131582 | A1 | 9/2013 |
| WO | 2013189524 | A1 | 12/2013 |

* cited by examiner

DEVICE FOR SWITCHING A DIRECT CURRENT

BACKGROUND OF THE INVENTION

Field of the Invention

The invention further relates to a method for switching off a direct current with such a device.

A device of the type named above is known from the international patent application WO 2013/131582 A1. In this known device, the commutation device comprises a series circuit of two-pole sub modules, wherein each sub module has an energy store and a power semiconductor circuit. In order to charge up the energy stores of the sub modules, a charging branch is provided which connects the switch-off current path, which has a high voltage potential, to the ground potential. The energy supply of the commutation device here requires a considerable outlay.

BRIEF SUMMARY OF THE INVENTION

The invention is based on the object of providing a device and a method with which direct currents can be safely switched off in a simple and economical manner. This object is achieved according to the invention by a device as described below and by a method as described below. Advantageous embodiments of the device and of the method are given in the dependent claims.

A device for switching a direct current with an operating current path that comprises a mechanical switch, a switch-off current path that comprises a power electronic switch connected in parallel with the operating current path, and a commutation device which enables commutation of the direct current from the operating current path into the switch-off current path is disclosed, wherein the commutation device comprises a transformer. It is particularly advantageous here that commutation of the direct current from the operating current path into the switch-off current path is done by means of a transformer.

The device can be designed such that the transformer comprises a first winding and a second winding which are electrically isolated. An electrical isolation is advantageously achieved in this way, so that the switch-off current path is electrically isolated with respect to the other units connected to the transformer.

The device can also be designed such that an electrical isolation resistant to high voltages is arranged between the first winding and the second winding of the transformer. A large potential difference between the switch-off current path and the other units connected to the transformer can advantageously be realized in this way.

The device can also be designed such that the switch-off current path comprises a series circuit of the second winding of the transformer and the power electronic switch. This design advantageously allows a commutation voltage to be inserted into the switch-off current path by means of the second winding of the transformer.

The device can also be designed such that the first winding of the transformer is connected to a feed unit, by means of which the voltage occurring at the second winding of the transformer can be influenced, in particular adjusted. With this design it is possible for the voltage occurring at the second winding of the transformer (commutation voltage) to be affected, i.e. adjusted, with the aid of the feed unit.

The device can advantageously also be designed such that the feed unit comprises a converter. With the aid of the converter a voltage that can be changed over a wide range can be applied to the first winding of the transformer, so that as a result the voltage arising at the second winding of the transformer can be influenced over a wide range, i.e. can be adjusted.

The device can also be designed such that the feed unit comprises an energy store, in particular a capacitor. A feed unit with such an energy store advantageously allows the device to operate self-sufficiently in terms of energy. This is, for example, particularly advantageous in the event of a power failure in a direct current high-voltage network that is connected to the device.

The device can here be designed such that the energy store is designed for storing the electrical energy necessary for the commutation. The electrical capacity of the energy store is here in particular selected such that the energy store stores a sufficiently large quantity of electrical energy to carry out the complete commutation process.

The device can also be designed such that the power electronic switch is constructed to carry the direct current in both directions and to switch off such a direct current (i.e. to switch off direct currents flowing in both directions). This makes it possible to switch off a direct current that is flowing in one direction in the operating current path with the device. If necessary, however, a direct current that is flowing in the operating current path in the opposite direction can also be switched off with the device.

The device can here be constructed such that the power electronic switch comprises an anti-serial circuit of a plurality of switching modules. Each switching module can here comprise a switching element with a diode connected anti-parallel. The switching element can, in particular, be a power semiconductor switch.

The device can also be designed such that the operating current path and the switch-off current path are at a high voltage potential, and the first winding of the transformer and the feed unit are at a low voltage potential. The first winding of the transformer and the feed unit can, in particular, be connected to ground potential. This advantageously permits the application of the device in high-voltage direct current networks in order to switch off direct currents in branches of this high-voltage direct current network.

A method is further disclosed for switching off a direct current in a device with

- an operating current path that comprises a mechanical switch,
- a switch-off current path that comprises a power electronic switch connected in parallel with the operating current path, and
- a commutation device which enables commutation of the direct current from the operating current path into the switch-off current path and which comprises a transformer, wherein in the method
- the direct current flows first through the operating current path, the mechanical switch being closed,
- a commutation voltage is inserted (injected) by means of the transformer into the switch-off current path,
- a commutation current flowing through the switch-off current path and the operating current path is generated as a result of the commutation voltage, wherein the commutation current in the operating current path has the opposite direction to the direct current, the current flowing through the operating current path is reduced as a result of the commutation current, and the mechanical switch is thereupon opened.

It is in particular advantageous here that the commutation voltage is inserted into the switch-off current path by means of the transformer. This makes it possible to insert the commutation voltage into the switch-off current path with an electrical isolation realized by means of the transformer, in particular with a complete potential isolation. With this method, the device can be constructed according to all the variants given above.

The method can be designed such that the mechanical switch is not opened until a characteristic magnitude of the current flowing through the operating current path falls below a predetermined threshold value. In particular, the mechanical switch can only be opened when the current intensity of the current flowing through the operating current path has fallen below a predetermined threshold value.

Such a characteristic magnitude can, for example, be a measured value i(t) of the current flowing through the operating current path, a mean value of the measured current during a predetermined interval of time, or another value related to the current. In the ideal case, the mechanical switch is not opened until the current flowing through the operating current path has reached the value zero. No arc then arises when the mechanical switch is opened. In practice, the mechanical switch can however be opened as soon as the current flowing in the operating current path has fallen below a (small) predetermined threshold value. As a result of the small current still flowing, a (small) arc does arise in the mechanical switch, but it is, however, not harmful if the switch has appropriate resistance to arcing.

The method can also proceed such that (after the mechanical switch has opened) the current flowing through the switch-off current path is switched off by means of the power electronic switch.

The direct current that has been commutated from the operating current path into the switch-off current path is thus switched off by means of the power electronic switch, whereby it is possible to switch the direct current off quickly.

The method can also be realized such that the operating current path and the switch-off current path are operated at a high voltage potential, and the first winding of the transformer and the feed unit are operated at a low voltage potential, in particular being connected to ground potential.

The method moreover exhibits the advantages that are given above in connection with the device.

BRIEF DESCRIPTION OF THE SEVERAL VIEWS OF THE DRAWING

The invention is explained in more detail with reference to exemplary embodiments below. Here

DESCRIPTION OF THE INVENTION

Figure 1:
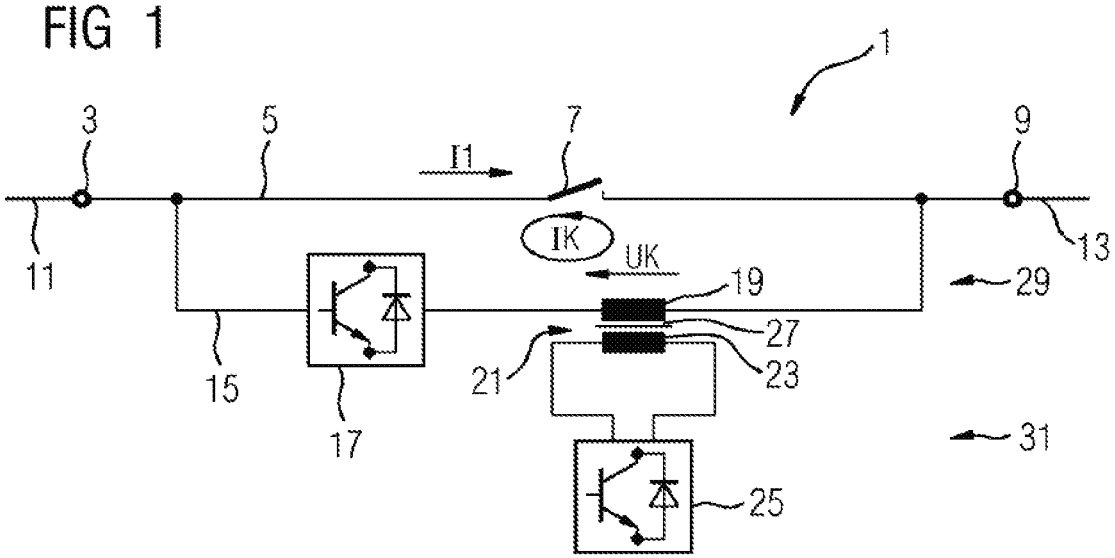
FIG. 1 shows a schematic diagram of an exemplary device.

An exemplary embodiment of a device 1 for switching a direct current I1 is illustrated in FIG. 1. This device 1 can also be referred to as a direct current switch 1. The device 1 comprises a first terminal 3, which is connected electrically to an operating current path 5. The operating current path comprises a mechanical switch 7 one of whose contacts is electrically connected to the first terminal 3 and whose other contact is electrically connected to a second terminal 9. The first terminal 3 is connected to a first conductor 11 of a high voltage direct current network, not further illustrated, while the second terminal 9 is connected to a second conductor 13 of this high voltage direct current network. When the device 1 is in the switched-on state, the mechanical switch 7 is closed. Although in FIG. 1 the mechanical switch 7 is illustrated in the open state, in the description which follows it is nevertheless assumed that the mechanical switch (contrary to the illustration of FIG. 1) is closed. When in the switched-on state, the electrical direct current I1 flows from the first conductor 11 through the first terminal 3, the closed mechanical switch 7 of the operating current path 5 and the second terminal 9 to the second conductor 13. In the closed state, the mechanical switch 7 has a very low contact resistance, and therefore only very small electrical losses occur when current flows through the mechanical switch 7. The device 1 is therefore able, when switched on, to pass the electrical current with only low electrical conduction losses.

The device 1 furthermore comprises a switch-off current path 15 which is connected in parallel with the operating current path 5. This switch-off current path 15 is realized in the exemplary embodiment as an electrical series circuit of a power electronic switch 17 and a second winding 19 of a transformer 21. A first winding 23 of the transformer 21 is connected electrically to a feed unit 25. The transformer 21 and the feed unit 25 constitute a commutation device.

The first winding 23 of the transformer 21 is the primary winding, while the second winding 19 of the transformer 21 is the secondary winding. The first winding 23 and the second winding 19 are electrically isolated, and an electrical isolation 27 resistant to high voltage is arranged between the first winding 23 and the second winding 19. An electrical isolation between the second winding 19 and the feed unit 25 is created in this way. The feed unit 25 and the second winding 19 can thereby be realized at an entirely different electrical potential. In particular, the potential of the second winding 19 (as also the potential of the mechanical switch 7, the power electronic switch 17, the first terminal 3 and the second terminal 9) can be designed to have a high voltage potential 29, while the first winding 23 and the feed unit 25 have a low voltage potential 31. It is particularly advantageous here that the energy supply of the feed unit 25 can be provided at a low voltage potential 31, whereby an expensive and complex energy supply at high voltage potential 29 is unnecessary. It is furthermore advantageous, that the actuation of elements of the feed unit can be performed at low voltage potential 31. The power electronics of the feed unit 25 can accordingly also be realized at a low voltage potential or at ground potential. Only a small isolation outlay is thus necessary for the feed unit 25, since this is at a low voltage potential or ground potential.

The feed unit 25 generates an electrical voltage which is applied to the first winding 23 of the transformer 21. The feed unit is thus able to affect the voltage occurring at the second winding 19 of the transformer as a result of the induction. The feed unit 25 and the transformer 21 thus serve to introduce a voltage that acts as a commutation voltage into the switch-off current path 15. This commutation voltage is illustrated in FIG. 1 with a voltage arrow Uk. The electrical circuit with the mechanical switch 7, the power electronic switch 17 and the transformer 21 form a commutation loop of the device 1. The insertion of the commutation voltage Uk into the switch-off current path 15 permits active commutation, i.e. the active initiation of the commutation process by means of the commutation voltage Uk.

When the device 1 is switched on, the mechanical switch 7 and the power electronic switch 17 are closed (switched on). In this switched-on state, the direct current I1 flows almost entirely through the operating current path 5 via the mechanical switch 7, since the mechanical switch 7 exhibits a significantly lower contact resistance than the power electronic switch 17. If the direct current I1 is to be switched off by means of the device 1, this is not simply possible at a high direct current I1 by opening the mechanical switch 7. If a high current I1 were switched off by means of the mechanical switch 7 alone, an arc would arise in the mechanical switch 7 which could damage or destroy it. For this reason, the direct current I1 is diverted/commutated from the operating current path 5 into the switch-off current path 15 in order to switch it off; a commutation of the current I1 from the operating current path 5 into the switch-off current path 15 takes place. To carry out this commutation, an electrical voltage is applied by means of the feed unit 25 to the first winding 23 of the transformer 21.

As a result of this voltage, a current flows through the first winding of the transformer. Due to the change of the current in the first winding 23 of the transformer, the commutation voltage Uk is induced in the second winding 19. Due to the commutation voltage Uk, a commutation current Ik flows in the commutation loop (i.e. in the mesh constituted by the operating current path 5 and the switch-off current path 15). This commutation current Ik has the opposite direction in the operating current path to the current I1 that is to be switched off. The direct current in the operating current path 5 is reduced by this commutation current directed in the opposite direction.

As soon as a characteristic magnitude of the direct current I1 falls below a predetermined threshold value, the mechanical switch 7 is opened. Such a characteristic magnitude of the direct current I1 can, for example, be the momentary value i(t) of the current I1 that is measured in the operating current path. In the ideal case, the mechanical switch 7 would not be opened until the direct current I1 flowing through the mechanical switch 7 has reached the value zero. In this case, no arc at all arises in the mechanical switch 7. The mechanical switch 7 can also however be opened once the direct current I1 flowing through the mechanical switch 7 has adopted a small value (for example when the direct current I1 falls below the value 100 A). It is true that in this case an arc arises when the mechanical switch 7 is opened. With a suitable, arc-resistant design of the mechanical switch 7, however, it is not damaged by this (weak) arc. When the direct current in the operating current path 5 has reached the value zero, and any arc that might have arisen in the mechanical switch 7 has extinguished, the isolation segment of the mechanical switch 7 can accept voltage.

When the direct current I1 flowing through the operating current path is made smaller and smaller by the commutation current Ik, the direct current flowing through the switch-off current path 15 conversely becomes larger and larger.

The direct current I1 thus commutates from the operating current path 5 into the switch-off current path 15. After the direct current I1 has commutated (entirely or almost entirely) into the switch-off current path 15, the power electronic switch 17 is opened, and the direct current I1 thereby switched off. The power electronic switch 17 is able to absorb the switching energy occurring at switch-off, and to convert it into heat energy. Switching off the direct current I1 is thereby completed.

Figure 2:
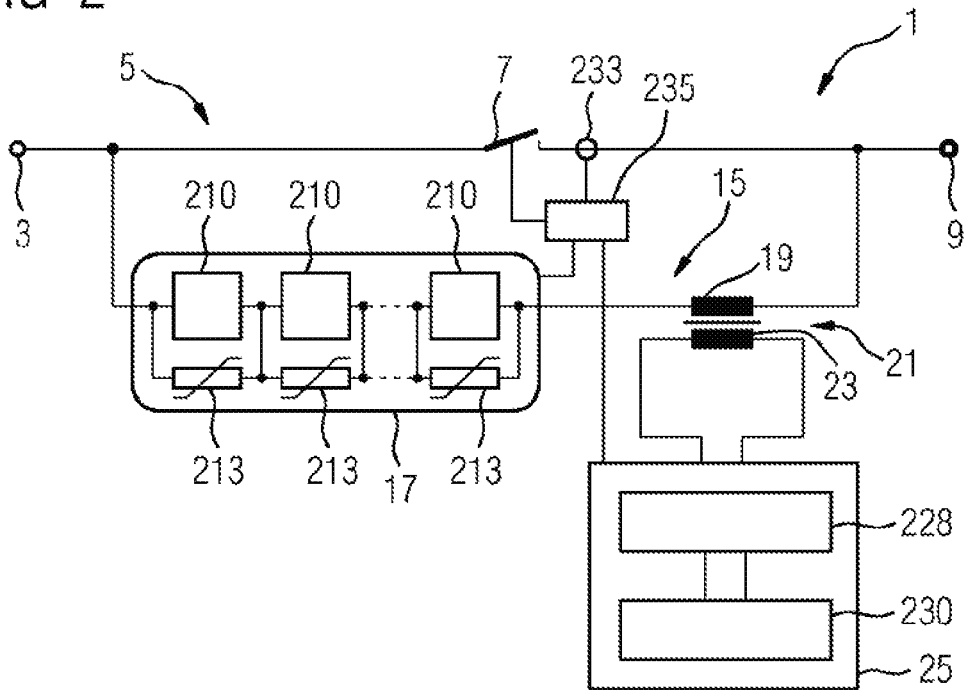
FIG. 2 shows a detailed circuit diagram of the device.

The device 1 of FIG. 1 is illustrated with further details in FIG. 2. It can be seen that the power electronic switch 17 comprises a plurality of switching modules 210 connected in series, a surge arrester 213 being connected in parallel with each. The surge arrester can, for example, be designed as a metal oxide varistor. Such metal oxide varistors exhibit a particularly advantageous characteristic curve. The surge arrester acts to absorb or convert the switching energy arising when switching off. The surge arrester 213 moreover serves to protect the switching module 210 from excessive voltage spikes.

The power electronic switch 17 can also be implemented such that it only comprises one switching module 210 with a surge arrester 213 connected in parallel. In that case this one switching module is designed with such a voltage resistance that this switching module can accept all the voltage present at the power electronic switch 17. If, however, the power electronic switch 17—as illustrated in FIG. 2—comprises a plurality of switching modules 210 connected in series, then the voltage that is to be switched is distributed over the individual switching modules, so that each of these switching modules 210 only has to accept a lower voltage resistance. This allows economical switching modules with a lower permitted switching voltage to be employed.

It is further illustrated in FIG. 2 that the feed unit 25 comprises a converter 228 and an energy store 230. The energy store 230 can, for example, be designed as a capacitor 230. The energy store 230 stores the energy required to commutate the direct current I1 when the device 1 is in the switched-on state. The energy store 230 can, for example, be supplied with electrical energy from a conventional low-voltage network, for example a 380 V alternating current network. When the energy store 230 is charged, it allows the device 1 to operate self-sufficiently in terms of energy even in the case in which the energy supply network that is supplying the energy store 230 fails.

The converter 228 serves to feed the transformer 21. A conventional converter, known to the expert, such as a converter constructed as a bridge circuit, can be used as the converter 228. The circuit of the converter 228 can also be constructed differently; it is for example possible here for a standard converter, as are available for industrial drives for various powers, to be used.

By means of the converter 228 the primary current flowing through the first winding 23 of the transformer 21 can be controlled over a wide range. This makes it possible for the commutation process to be purposefully controlled.

By means of the converter 228 it is for example possible for a direct voltage to be applied to the first winding 23 of the transformer 21. For a short time, a linearly rising current (with constant di/dt) consequently flows in the first winding 23 (which represents an inductance). As a result of this linearly rising current in the first winding 23, a commutation voltage is induced in the second winding 19 of such a nature that the commutation current Ik also develops (at least briefly) as a linearly rising current. The commutation process can be carried out by means of this commutation current Ik.

In another exemplary variant, an alternating voltage can be applied to the first winding 23 of the transformer 21 by means of the converter 228. An alternating voltage is thereby induced in the second winding 19. The commutation current IK flows in the commutation loop on account of this alternating voltage.

However, other voltage signals can also be applied to the first winding 23 of the transformer by means of coverter 228.

It is only important that a commutation current Ik, whose direction is opposed to the direct current I1 flowing through the mechanical switch 7, begins to flow in the commutation loop as a result of the commutation voltage Uk induced in the second winding 19.

FIG. 2 further illustrates a current sensor 233, which measures the current flowing through the operating current path 5 (and thus the current flowing through the mechanical switch 7), producing measured current values. The current sensor 233 transmits these measured current values to a controller 235 which evaluates the measured current values. As soon as the controller 235 detects that a characteristic magnitude of the current I1 flowing through the operating current path 5 falls below a predetermined threshold value, it sends an open command to the mechanical switch 7. Later (when the mechanical switch 7 is open), the controller 235 additionally sends an open command to the power electronic switch 17. The controller 235 can, furthermore, also operate the converter 228 in such a way that it outputs an appropriate voltage to the first winding 23 of the transformer 21 to initiate the commutation process. The controller 235 thus controls the entire switch-off process of the direct current I1.

It is advantageous here that, as a result of the electrical isolation/potential isolation of the transformer, the actuation of the power electronic converter 228 can be carried out with a low voltage potential, and does not have to be performed at a high voltage potential. Only low outlay thus arises for electrical isolation, cooling and communication with the converter 228. A simple and economical realization of the device 1 results in this way. An electrical isolation between the energy store 230 and the commutation loop 7, 17, 19 is furthermore advantageously achieved by means of the transformer. The energy store 230 can as a result be supplied/charged up with electrical energy very easily and with a little outlay.

Figure 3:
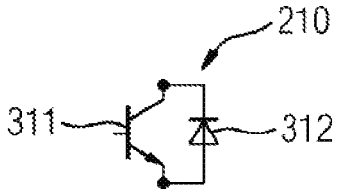
FIG. 3 shows an exemplary embodiment of a switching module with a power semiconductor switch and a freewheeling diode.

The way in which a switching module 210 can be constructed is illustrated by way of example in FIG. 3. FIG. 3 shows a very simply constructed switching module 210, consisting merely of a switching element 311 and a free-wheeling diode 312 connected with it in anti-parallel. A power semiconductor switch 311 that can be switched on and off can, for example, be employed as the switching element 311. A wide variety of power semiconductor components can be employed as the switching element 311, for example a power transistor, an IGBT (insulated-gate bipolar transistor) or a GTO (gate turn-off thyristor).

Figure 4:
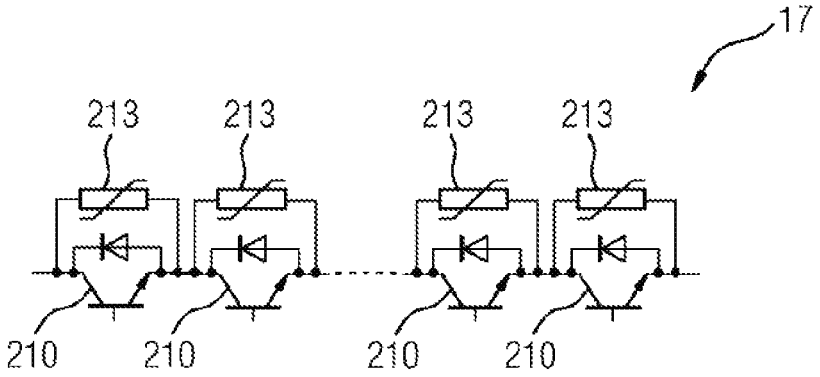
FIG. 4 shows an exemplary embodiment of a power electronic switch with a plurality of switching modules.

An exemplary embodiment of the power electronic switch 17 is illustrated in FIG. 4. The power electronic switch 17 comprises a plurality of switching modules 210 that are constructed similarly to the switching module illustrated in FIG. 2. The number of switching modules is variable, and can be selected in accordance with the level of the electrical voltage present at the switch 17. The switching modules 210 are connected in series (series connection of the switching modules 210), wherein all the switching modules have the same polarity. A surge arrester 213 is connected in parallel with each switching module 210. By means of this power electronic switch 17, a direct current flowing in one direction can be switched off.

Figure 5:
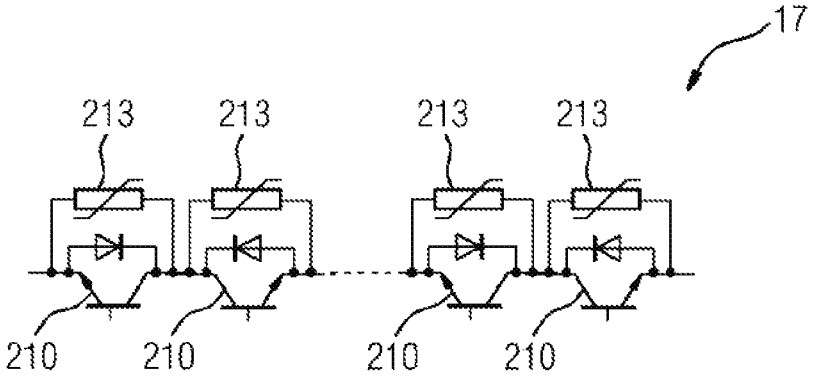
FIG. 5 shows a further exemplary embodiment of a power electronic switch with a plurality of switching modules.

A further exemplary embodiment of a power electronic switch 17 is illustrated in FIG. 5. This power electronic switch 17 comprises a plurality of switching modules 210 which are constructed similarly to the switching modules illustrated in FIG. 2. These switching modules 210 are connected in anti-series. In this anti-serial connection of the switching modules 210, the polarity of the switching modules changes; neighboring switching modules, for example, have different polarities. In other words, the switching modules 210 of the power electronic switch 17 have opposing polarities. As a result, direct currents flowing in both directions can be switched off by means of this power electronic switch 17. As in the power electronic switch of FIG. 4, a surge arrester 213 is connected in parallel with each switching module 210.

When the power electronic switch 17 according to FIG. 5 is used, direct currents flowing in both directions can be switched off with the device 1. Thus direct currents that flow like the direct current I1 of FIG. 1 can be switched off, and direct currents that flow in the opposite direction can be switched off. The converter 228 can here be designed such that it can apply the voltage to the first winding 23 with any polarity (for example through a bipolar implementation of the converter 228).

Figure 6:
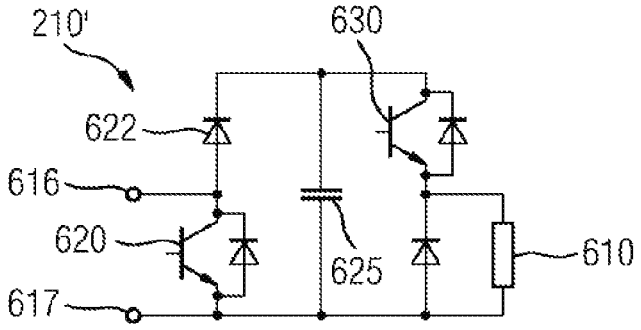
FIG. 6 shows an exemplary embodiment of a switching module that is designed as a braking chopper module.

FIG. 6 illustrates an exemplary embodiment of a switching module 210', which can replace a switching module 210, together with the parallel-connected surge arrester 213, in the device shown in FIG. 2. The switching module 210' of FIG. 6 is what is known as a braking chopper module, known per se, in which electrical energy can be converted into heat energy by means of an ohmic resistor 610. When the mechanical switch 7 is open and is able to accept voltage, the commutated direct current flows through terminals 616 and 617 into the switching module 210'. This direct current first flows through a switching element 620 connected directly to the terminals 616 and 617. When this switching element 620 is switched off, the direct current then flows through a diode 622 into a capacitor 625, and charges this capacitor 625 up. When the capacitor voltage exceeds a predetermined value, then a switching element 630 in the right-hand circuit branch is switched on, whereby the capacitor discharges through the resistor 610; the electrical energy is converted into heat in the resistor 610. The capacitor voltage falls as a result of the capacitor being discharged. When it falls below a predetermined lower voltage value of the capacitor voltage, the switching element 630 is switched off, and the capacitor 625 charges back up. This is continued until the commutated direct current is switched off.

The direct current switch 1 described, or the direct current power switch 1, can advantageously be employed in high-voltage direct current transmission networks (HVDC networks) in order to be able to switch off operating currents or fault currents. It can also be referred to as a high-voltage direct current power switch 1. As a result of the use of the mechanical switch 7 and the power electronic switch 17, low conduction losses are achieved when in the switched-on state; the power electronic switch 17 permits short reaction times and the ability to switch direct currents off quickly. By means of the commutation device, which comprises a transformer, large potential differences between the switch-off current path and the feed unit can be realized. Through this, the energy supply of the feed unit and/or the actuation of the feed unit are in particular simplified.

A device for switching a direct current and a method for switching a direct current have been described, with which, in particular, large direct currents at a high voltage potential can be switched off safely and economically.

The invention claimed is:

1. A device for switching a direct current, the device comprising:

an operating current path including a mechanical switch;

a switch-off current path connected in parallel with said operating current path, said switch-off current path including a power electronic switch, said power electronic switch including a plurality of switching modules and a plurality of surge arresters each being connected in parallel with a respective one of said switching modules;

a commutation device enabling commutation of a direct current from said operating current path into said switch-off current path, said commutation device including a transformer having a first winding and a second winding being electrically isolated; and a feed unit connected to said first winding of said transformer for influencing a voltage occurring at said second winding of said transformer, said feed unit including an energy storage device.

2. The device according to claim 1, wherein said transformer includes an electrical isolation being resistant to high voltages and being disposed between said first winding and said second winding.

3. The device according to claim 1, wherein said switch-off current path includes a series circuit of said second winding of said transformer and said power electronic switch.

4. The device according to claim 1, wherein said energy storage device is a capacitor.

5. The device according to claim 1, wherein said energy storage device is configured for storing electrical energy necessary for the commutation.

6. The device according to claim 1, wherein said power electronic switch is constructed to carry the direct current in both directions and to switch off the direct current carried in both directions.

7. The device according to claim 6, wherein said power electronic switch includes an anti-serial circuit of a plurality of switching modules, each of said switching modules including a respective switching element with a respective diode connected anti-parallel.

8. The device according to claim 1, wherein said operating current path and said switch-off current path are at a high voltage potential, and said first winding of said transformer and said feed unit are at a low voltage potential.

9. The device according to claim 8, wherein said first winding of said transformer and said feed unit are connected to ground potential.

10. The device according to claim 1, wherein said switching modules are connected in series and all have identical polarities.

11. The device according to claim 1, wherein said switching modules are connected in anti-series and include adjacent switching modules having opposing polarities.

12. A device for switching a direct current, the device comprising:

an operating current path including a mechanical switch;

a switch-off current path connected in parallel with said operating current path, said switch-off current path including a power electronic switch, said power electronic switch including a plurality of switching modules and a plurality of surge arresters each being connected in parallel with a respective one of said switching modules;

a commutation device enabling commutation of a direct current from said operating current path into said switch-off current path, said commutation device including a transformer having a first winding and a second winding being electrically isolated; and a feed unit connected to said first winding of said transformer for influencing a voltage occurring at said second winding of said transformer, said feed unit including a converter.

13. The device according to claim 12, wherein said switching modules are connected in series and all have identical polarities.

14. The device according to claim 12, wherein said switching modules are connected in anti-series and include adjacent switching modules having opposing polarities.

15. A method for switching off a direct current, the method comprising the following steps:

providing a device including:

an operating current path having a mechanical switch, a switch-off current path connected in parallel with the operating current path and having a power electronic switch, the power electronic switch including a plurality of switching modules and a plurality of surge arresters each being connected in parallel with a respective one of the switching modules, and a commutation device having a transformer and enabling commutation of a direct current from the operating current path into the switch-off current path, the transformer having a first winding and a second winding being electrically isolated;

connecting a feed unit to the first winding of the transformer for influencing a voltage occurring at the second winding of the transformer, the feed unit including an energy storage device configured for storing electrical energy necessary for the commutation;

conducting the direct current to initially flow through the operating current path with the mechanical switch being closed;

using the transformer to insert a commutation voltage (UK) into the switch-off current path;

generating a commutation current (IK) flowing through the switch-off current path and the operating current path as a result of the commutation voltage (UK), and providing the commutation current (IK) in the operating current path with a direction opposite to a direction of the direct current; and reducing the current flowing through the operating current path as a result of the commutation current (IK), causing the mechanical switch to open.

16. The method according to claim 15, which further comprises opening the mechanical switch only when a characteristic magnitude of the current flowing through the operating current path falls below a predetermined threshold value.

17. The method according to claim 15, which further comprises using the power electronic switch to switch-off the current flowing through the switch-off current path after the mechanical switch has opened.

18. The method according to claim 15, wherein the switching modules are connected in series and all have identical polarities.

19. The device according to claim 15, wherein the switching modules are connected in anti-series and include adjacent switching modules having opposing polarities.

20. A method for switching off a direct current, the method comprising the following steps:

providing a device including:

an operating current path having a mechanical switch, a switch-off current path connected in parallel with the operating current path and having a power electronic switch, the power electronic switch including a plurality of switching modules and a plurality of surge arresters each being connected in parallel with a respective one of the switching modules, and a commutation device having a transformer and enabling commutation of a direct current from the operating current path into the switch-off current path;

providing the transformer with a first winding and a second winding being electrically isolated;

connecting a feed unit to the first winding of the transformer for influencing a voltage occurring at the second winding of the transformer;

connecting the first winding of the transformer and the feed unit to ground potential;

operating the operating current path and the switch-off current path at a high voltage potential;

operating the first winding of the transformer and the feed unit at a low voltage potential;

conducting the direct current to initially flow through the operating current path with the mechanical switch being closed;

using the transformer to insert a commutation voltage (UK) into the switch-off current path;

generating a commutation current (IK) flowing through the switch-off current path and the operating current path as a result of the commutation voltage (UK), and providing the commutation current (IK) in the operating current path with a direction opposite to a direction of the direct current; and reducing the current flowing through the operating current path as a result of the commutation current (IK), causing the mechanical switch to open.

21. The device according to claim 20, wherein the switching modules are connected in series and all have identical polarities.

22. The device according to claim 20, wherein the switching modules are connected in anti-series and include adjacent switching modules having opposing polarities.

* * * * *